US007081835B2

(12) United States Patent
Fleischmann et al.

(10) Patent No.: US 7,081,835 B2
(45) Date of Patent: Jul. 25, 2006

(54) CONTROL DEVICE FOR THE ACTUATION OF LAMPS

(75) Inventors: Walter Fleischmann, Allersberg (DE); Carsten Kohlmeier-Beckmann, Buxtehude (DE)

(73) Assignees: Diehl Luftfahrt Elektronik GmbH, Röthenbach (DE); Airbus Deutschland GmbH, Hamburg (DE)

( * ) Notice: Subject to any disclaimer, the term of this patent is extended or adjusted under 35 U.S.C. 154(b) by 288 days.

(21) Appl. No.: 10/455,035

(22) Filed: Jun. 5, 2003

(65) Prior Publication Data

US 2004/0140776 A1 Jul. 22, 2004

(30) Foreign Application Priority Data

Jan. 20, 2003 (DE) ..... 203 00 902 U

(51) Int. Cl.
*G08B 21/00* (2006.01)

(52) U.S. Cl. ..... 340/945; 340/815.4; 340/971; 362/471

(58) Field of Classification Search ..... 340/945, 340/956, 815.4, 815.45, 815.47, 815.73
See application file for complete search history.

(56) References Cited

U.S. PATENT DOCUMENTS

| | | | | |
|---|---|---|---|---|
| 4,968,917 | A * | 11/1990 | Harris | 315/77 |
| 5,381,074 | A * | 1/1995 | Rudzewicz et al. | 315/77 |
| 5,677,603 | A * | 10/1997 | Speirs et al. | 315/324 |
| 5,825,133 | A * | 10/1998 | Conway | 315/105 |
| 6,841,947 | B1 * | 1/2005 | Berg-johansen | 315/169.3 |
| 2005/0063194 | A1 * | 3/2005 | Lys et al. | 362/545 |

* cited by examiner

*Primary Examiner*—Benjamin C. Lee
*Assistant Examiner*—Son Tang
(74) *Attorney, Agent, or Firm*—Scully, Scott, Murphy & Presser

(57) ABSTRACT

A control device for the actuation of lamps in particular for internal aircraft lighting, wherein the control device (1) has an input (18) for the supply of an input signal and a plurality of outputs (21–28) for passing output signals to connected lamps (L1–L8). In the control device (1) a signal processing module (8–12) is preferably formed by a microprocessor and a preferably freely programmable electronic memory (13–17). The signal processing module (8–12) produces the output signals from the input signal in accordance with a conversion instruction deposited in the memory (13–17), wherein different conversion instructions can be stored in the memory (13–17) for output signals belonging to different outputs (21–28).

7 Claims, 1 Drawing Sheet

CONTROL DEVICE FOR THE ACTUATION OF LAMPS

BACKGROUND OF THE INVENTION

1. Field of the Invention

Figure 1:
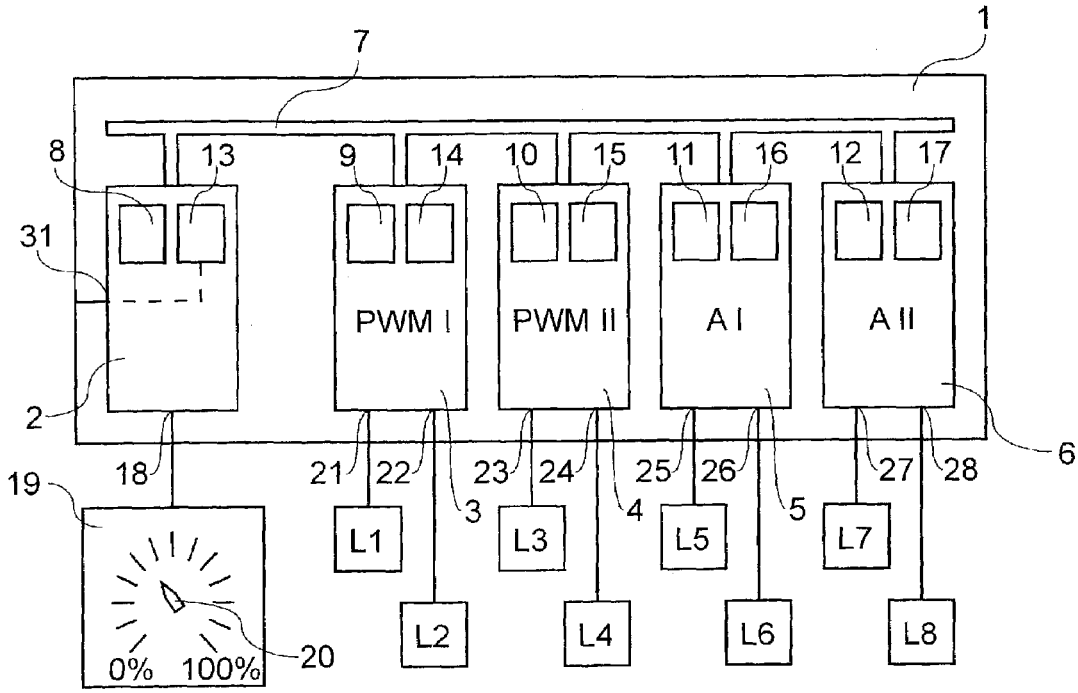

The invention concerns a control device for the actuation of lamps in particular of internal aircraft lighting, wherein the control device has an input for the supply of an input signal and a plurality of outputs for passing output signals to connected lamps, and a lighting system having such a control device, a regulating signal-producing means and a plurality of lamps.

2. Discussion of the Prior Art

Conventional lamp control devices are designed for controlling a given type of lamp. Thus they supply for example analog voltage signals for the actuation of halogen lamps, pulse width-modulated signals for the actuation of light emitting diodes, or frequency-modulated ac voltage signals for the actuation of electroluminescence lamps. Also, various lamps of a type of lamp often have different actuation characteristics so that one lamp with half electrical power also produces half the brightness while the other lamp for that purpose requires only 30% of the full electrical power.

In case that now a plurality of lamps of different types or with different lamp characteristics are to be controlled together, that is to say they are for example to be dimmed jointly from a brightness of 100% to a brightness of 50%, it is then necessary, for each type of lamp or for each lamp characteristic, to use its own specific control device to which the respective signal 'half brightness' has to be passed. The foregoing involves a considerable degree of structural expenditure.

SUMMARY OF THE INVENTION

Accordingly it is an object of the invention to provide a control device with which lamps of various types or involving differing lamp characteristics can be uniformly controlled.

The foregoing object is attained through the provision of a control device for the actuation of lamps, which device incorporates a signal processing module, preferably formed by a microprocessor, and a preferably freely programmable electronic memory, wherein the signal processing module produces the output signals from the input signal in accordance with a conversion instruction deposited in the memory, and wherein different conversion instructions can be stored in the memory for output signals belonging to different outputs.

Another object resides in the provision of a lighting system comprising a regulating signal-producing device, a control device as described herein and a plurality of lamps, wherein the signal-producing device is connected to the input of the control device and delivers the input signal, and the lamps are connected to the outputs of the control device and accept the output signals.

Provided in the control device are a signal processing module preferably formed by a microprocessor and a preferably freely programmable electronic memory, and the signal processing module (8–12) produces the output signals from the input signal in accordance with a conversion instruction deposited in the memory, wherein different conversion instructions can be stored in the memory for output signals belonging to different outputs. In that way the characteristic of the respectively connected lamp can be taken into account and uniform actuation of lamps of different types or involving different lamp characteristics becomes possible.

In a preferred embodiment the control device is of a modular structure and includes a data module which has the input and at least one control module which has one or more outputs. Preferably the data module and the control module or modules are connected together by way of a bus system. In that case different types of control modules can be used for different types of lamps. They may produce analog, pulse width-modulated, frequency-modulated and/or other signals.

A further development of the invention provides that disposed in each control module are, respectively a signal processing module and an electronic memory for producing the output signals in accordance with the input signal. In addition, there may also be an electronic memory in the data module, into which memory the conversion instructions can be written. It is particularly preferable if the conversion instructions are then transmitted from the data module into the memory modules as in that way new conversion instructions can be stored centrally in the data module and thereafter independently distributed to the memory modules.

The conversion instructions may involve an actuation characteristic curve for the respective lamp to be connected or, however, also freely programmable control instructions which in a particularly preferred embodiment can contain program operations which are triggered by way of a given value of the input signal.

The lamps can be connected to the outputs of the control device directly and/or by way of a series reactor device.

A lighting system can be formed through the control device, wherein a regulating signal-producing means or device is connected to the input of the control device and delivers the input signal and the lamps are connected to the outputs of the control device and take off the output signals.

BREIF DESCRIPTION OF THE ACCOMPANYING DRAWINGS

Figure 2A:
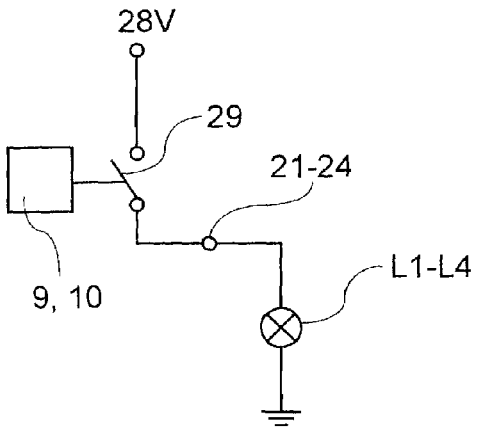
Figure 2B:
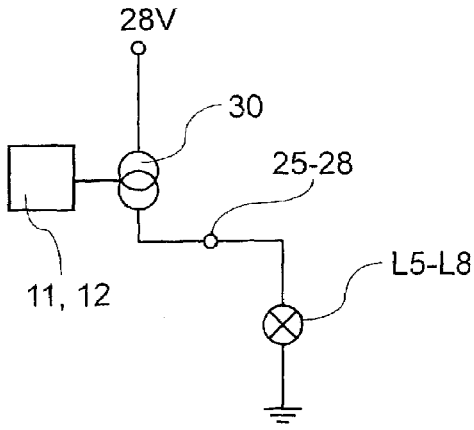

An embodiment of the invention is described in greater detail hereinafter with reference to the diagrammatic drawing showing the principle involved, in which:

FIG. 1 shows a lighting system with a control device in the form of a block circuit diagram, FIG. 2*a* shows a pulse width-modulated lamp actuation arrangement, and FIG. 2*b* shows an analog lamp actuation arrangement.

DETAILED DESCRIPTION OF PREFERRED EMBODIMENTS

A control device 1 has a data module 2 and four control modules 3–6. The control modules 3–6 are connected to the data module 2 by way of an internal bus 7. Both the data module 2 and also the control modules 3–6 each have a microprocessor 8–12 and an electronic memory 13–17. Connected to an input 18 is a regulating signal-producing means 19 with which an analog or preferably digital regulating signal is produced, which corresponds to the position of a rotatable setting knob 20 and which is transmitted to the data module 2. Lamps L1–L8 are connected to the outputs 21–28.

The data module 2 and the control modules 3–6 are each in the form of plug-in modules (comparable to PC cards) and can be easily replaced in that way.

Thus, for example, control modules of one type can be easily replaced by control modules of another type, thereby affording a high level of flexibility for the system.

In the illustrated embodiment, the control modules 3 and 4 (PWMI and PWMII) produce pulse width-modulated signals at their outputs 21–24. They are produced in accordance with the circuit diagram in FIG. 2*a*, the respective microprocessor 9 or 10 actuating the switch 29 in a cyclically controlled fashion. The control modules 5 and 6 (AI and AII) produce at their outputs 25–28 analog control signals which are produced, as shown by the circuit diagram in FIG. 2*b*, the respective microprocessor 11 or 12 controlling a current source 30. It will be appreciated that all known actuation processes for the lamps L1–L8 can be used in accordance with the invention.

The data module 2 (as shown in FIG. 1) also has an input 31 by way of which conversion instructions can be read into the memory 13 in digital data form. Stored in the memory 13 for each of the outputs 21–28 is a conversion instruction which is intended to apply for the lamp L1–L8 connected to the respective output 21–28. As soon as the control modules 3–6 are inserted and connected to the data module 2 by way of the data bus 7, the corresponding conversion instructions are transferred into the respective memories 14–17 of the control modules 3–6. Thus, in each of the memories 14–17 there are two conversion instructions which are associated with the two respective outputs 21, 22; 23, 24; 25, 26; 27, 28 respectively of the control modules 3–6.

Stored in the conversion instructions is the way in which the lamp connected to the respective output is to be actuated in order to represent the regulating signal, predetermined by way of the regulating signal-producing means 19 (for example, a given brightness value) with the lamp. That is dependent, on the one hand, on the manner of actuation (for example pulse width-modulated, analog or also frequency-modulated), but also, on the other hand, it is dependent on the nature of the connected lamp (for example, light emitting diodes, halogen lamps, fluorescent lamp or electroluminescence lamp) and their actuation characteristic.

The information for the conversion instructions can be stored in the form of characteristic curves which can be produced as desired or, however, also in the form of program operations in respect of time, which are triggered by a given regulating signal, that is to say, for example, when the brightness value reaches, exceeds or also falls below a given predetermined value.

It can also be provided that the lamps L7 and L8 which are connected to the control module 6 (for example, fluorescent lamps), for example, in the case of a given predetermined degree of dimming, are to be dimmed down to a greater amount than the lamps L5 and L6 which are connected to the control module 5 (for example, halogen lamps). In addition, it can further be provided in the conversion instructions that, below a given degree of dimming, the lamps L1 and L2 which are connected to the control module 3 (for example light emitting diodes) are to be switched on while the lamp L3 connected to the control module 4 by way of the connection 23 (for example, also light-emitting diodes) lights with a somewhat greater level of brightness and the lamp L4 which is connected to the output 24 of the control module 4 (once again light emitting diodes) is actuated in a flashing mode. In this manner, very different lighting scenarios can be produced by way of the control device and a single predetermined regulating signal.

In a preferred development of the invention, there can also be provided that the input signal which is to be read into the data module 2 is of a multi-channel nature. Allocation of the various channels to the individual outputs 21–28 of the control modules 3–6 can then be implemented by way of the software which is read into the memory 13 of the data module 2.

Besides the direct connection of the lamps L1–L8 to the outputs 21–28 of the control modules 3–6, it is also possible to connect series reactor devices to those outputs 21–28, in which case the lamps L1–L8 are then connected to those series reactor devices. In that case, the respective control module 3–6 produces at the corresponding outputs 21–28 a signal which is suitable for the respective series reactor device (for example, also a digital signal).

The described control device therefore affords many possible ways of controlling different lamps involving different actuation characteristics and also different types of lamp by means of a simple regulating signal, thereby affording a high degree of variability.

The invention claimed is:

1. A control device for the actuation of lamps for internal aircraft lighting, wherein the control device (1) has an input (18) for the supply of an input signal and a plurality of outputs (21–28) for passing output signals to connected lamps (L1–L8), wherein the control device (1) has a plurality of signal processing modules (8–12) provided therein and each including, respectively, a freely programmable electronic memory (13–17), said the signal processing modules (8–12) producing the output signals from the input signal in accordance with a conversion instruction deposited in the respective memories (13–17), and wherein different conversion instructions are storable in said respective memory (13–17) for output signals associated with different outputs (21–28), said control device (1) being a modular structure comprising a data module (2), comprising a signal processing module (8) and electronic memory (13), and having the input (18) receiving signals from a regulating signal-producing device (19), and a plurality of control modules (3–6) having one or more of said outputs (21–28), wherein the data module (2) and the plurality of control modules (3–6) are interconnected by way a bus system (7); different types of said plurality of control modules (3–6) being employable for different types of lamps (L1–L8), said control modules selectively supplying analog, pulse width-modulated and/or frequency-modulated output signals to said lamps; and each said control module (3–6) being provided with, respectively, one said signal processing module (9–12) and one of said electronic memories (14–17) for producing the output signals in accordance with the input signals derived from said conversion instructions.

2. A control device according to claim 1, wherein each said signal processing module (8–12) comprises a microprocessor.

3. A control device according to claim 1, wherein the electronic memory (13) in the data module (2) receives and stores the programmable conversion instructions, and wherein from said electronic memory (13) the conversion instructions are transferable from the data module (2) into the memory (14–17) of respectively each of the control modules (3–6).

4. A control device according to claim 1, wherein the programmable conversion instruction is derived from an actuation characteristic curve.

5. A control device according to claim 1, wherein the conversion instruction is freely programmable and contains a program operation which is triggered by a given value of the input signal from said regulating signal-producing device (19).

6. A control device according to claim 1, wherein the lamps (L1–L8) are selectively connected to the outputs (21–28) of the control device (1) directly or through a series reactor device.

7. A lighting system comprising a regulating signal-producing means (19), a control device (1) and a plurality of lamps (L1–L8), according to claim 1, wherein the regulating signal-producing means (19) is connected to the input (18) of the control device (1) and delivers the input signal and the lamps (L1–L8) are connected to the outputs (21–28) of the control device (1) and assume the output signals.

* * * * *